US010035169B2

(12) United States Patent
Bevier et al.

(10) Patent No.: US 10,035,169 B2
(45) Date of Patent: Jul. 31, 2018

(54) METHOD AND APPARATUS FOR RETAINING AND TRANSFERRING AN ARTICLE

(71) Applicant: NIKE, Inc., Beaverton, OR (US)

(72) Inventors: Joseph J. Bevier, Portland, OR (US); Travis K. Ernst, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 447 days.

(21) Appl. No.: 14/718,805

(22) Filed: May 21, 2015

(65) Prior Publication Data

US 2016/0339472 A1 Nov. 24, 2016

(51) Int. Cl.

| | |
|---|---|
| ***B05C 13/02*** | (2006.01) |
| ***B41J 3/407*** | (2006.01) |
| ***B41J 2/01*** | (2006.01) |
| ***B41J 11/00*** | (2006.01) |
| ***B41J 11/04*** | (2006.01) |
| ***A43B 3/00*** | (2006.01) |
| *D06P 5/30* | (2006.01) |
| *B65D 85/18* | (2006.01) |

(52) U.S. Cl.

CPC ..... *B05C 13/025* (2013.01); *A43B 3/0078* (2013.01); *B41J 2/01* (2013.01); *B41J 3/4078* (2013.01); *B41J 11/002* (2013.01); *B41J 11/04* (2013.01); *B41J 3/4073* (2013.01); *B65D 85/18* (2013.01); *D06P 5/30* (2013.01)

(58) Field of Classification Search

CPC ... B41J 11/04; B41J 3/4078; B41J 2/01; B41J 11/002; B41J 3/4073; B41J 2/00; B41F 17/005; D06P 5/30; B05C 13/025; A43B 3/0078; B65D 85/18

USPC ..... 101/415.1; 347/110, 20, 102, 104

See application file for complete search history.

(56) References Cited

U.S. PATENT DOCUMENTS

| | | | | |
|---|---|---|---|---|
| 2,199,973 | A * | 5/1940 | Sheeler | B41J 1/32 101/415.1 |
| 2,220,313 | A | 11/1940 | Batts | |
| 2,249,939 | A | 7/1941 | Branan | |
| 2,567,478 | A | 9/1951 | Hartline | |
| 2,953,915 | A | 9/1960 | Brainerd | |
| 2,963,206 | A * | 12/1960 | Vanghan, Jr. | A47F 7/10 12/114.6 |
| 3,169,680 | A * | 2/1965 | Horberg, Jr. | D06C 5/005 223/75 |
| 4,581,521 | A * | 4/1986 | Grise | H05B 3/58 219/528 |

(Continued)

FOREIGN PATENT DOCUMENTS

| | | |
|---|---|---|
| JP | H01238895 A | 9/1989 |
| WO | WO 2014/165590 | 10/2014 |
| WO | WO 2015/084528 | 6/2015 |

OTHER PUBLICATIONS

International Preliminary Report on Patentability and Written Opinion of the International Searching Authority, Application No. PCT/US2016/032103, dated Nov. 21, 2017 (9 pages).

*Primary Examiner* — Christopher M Koehler
*Assistant Examiner* — Mahdi H Nejad
(74) *Attorney, Agent, or Firm* — Klarquist Sparkman LLP

(57) ABSTRACT

A method and system for retaining and transferring an article uses a frame and a receptacle. The frame is inserted to interact with the receptacle. The article is placed over the frame and receptacle. The article and the frame may be simultaneously removed from the receptacle.

17 Claims, 16 Drawing Sheets

(56) References Cited

U.S. PATENT DOCUMENTS 4,643,340 A 2/1987 Bailey
5,595,377 A * 1/1997 Tibbet ..... B23Q 3/18 269/244
5,664,793 A * 9/1997 Engibarov ..... B23B 31/16279 269/283
6,376,816 B2 * 4/2002 Cooper ..... H05B 3/46 219/537
9,297,097 B2 * 3/2016 Turner ..... B41F 15/18
9,321,257 B2 * 4/2016 Miller ..... B41F 17/005
9,475,309 B2 * 10/2016 Miller ..... B41F 17/005
9,566,778 B1 * 2/2017 Ernst ..... B41F 3/54
2001/0003336 A1 * 6/2001 Abbott ..... F27D 11/02 219/543
2002/0144653 A1 * 10/2002 Bush ..... B05C 3/09 118/400
2004/0108343 A1 6/2004 Bagni
2005/0158112 A1 * 7/2005 Silverbrook ..... B41J 15/044 400/691
2005/0199147 A1 * 9/2005 Schafer ..... B41F 13/08 101/415.1
2005/0241511 A1 * 11/2005 Gross ..... B41F 13/16 101/415.1
2013/0340484 A1 * 12/2013 Turner ..... B41F 15/18 66/171
2014/0158795 A1 * 6/2014 Na ..... B05B 1/1654 239/393
2014/0196618 A1 * 7/2014 Pervan ..... B41J 3/28 101/32
2014/0299009 A1 * 10/2014 Miller ..... B41F 17/005 101/36
2014/0300675 A1 * 10/2014 Miller ..... B41J 3/4073 347/104
2014/0300676 A1 * 10/2014 Miller ..... B41F 17/38 347/110
2015/0151552 A1 * 6/2015 Bevier ..... B41J 11/04 347/4
2015/0285430 A1 * 10/2015 Wang ..... A47B 9/04 248/188.5
2016/0023475 A1 * 1/2016 Bevier ..... B41J 11/04 101/483
2016/0347099 A1 * 12/2016 Ernst ..... B41J 11/04
2017/0050448 A1 * 2/2017 Jang ..... B41J 11/002
2017/0072703 A1 * 3/2017 Davison ..... B41J 3/4073
2017/0225500 A1 * 8/2017 Miller ..... B41M 7/0072
2017/0232764 A1 * 8/2017 Mashima ..... B41J 11/58 347/104

* cited by examiner

METHOD AND APPARATUS FOR RETAINING AND TRANSFERRING AN ARTICLE

BACKGROUND

The embodiments generally relate to a method and system for retaining and transferring an article of apparel. More specific aspects of the embodiments relate to transferring an article of apparel that includes a printed portion that may be wet or uncured.

Articles for a wearer's foot may include socks and articles of footwear, such as articles comprising an upper and a sole structure. A sock may be knitted and/or woven. Ink or other coloring materials can be printed onto articles, including socks and/or articles of footwear.

BRIEF DESCRIPTION OF THE DRAWINGS

The embodiments can be better understood with reference to the following drawings and description. The components in the Figures are not necessarily to scale, emphasis instead being placed upon illustrating the principles of the embodiments. Moreover, in the Figures, like reference numerals designate corresponding parts throughout the different views.

The foregoing Summary and the following Detailed Description will be better understood when read in conjunction with the accompanying figures.

DETAILED DESCRIPTION

Figure 1:
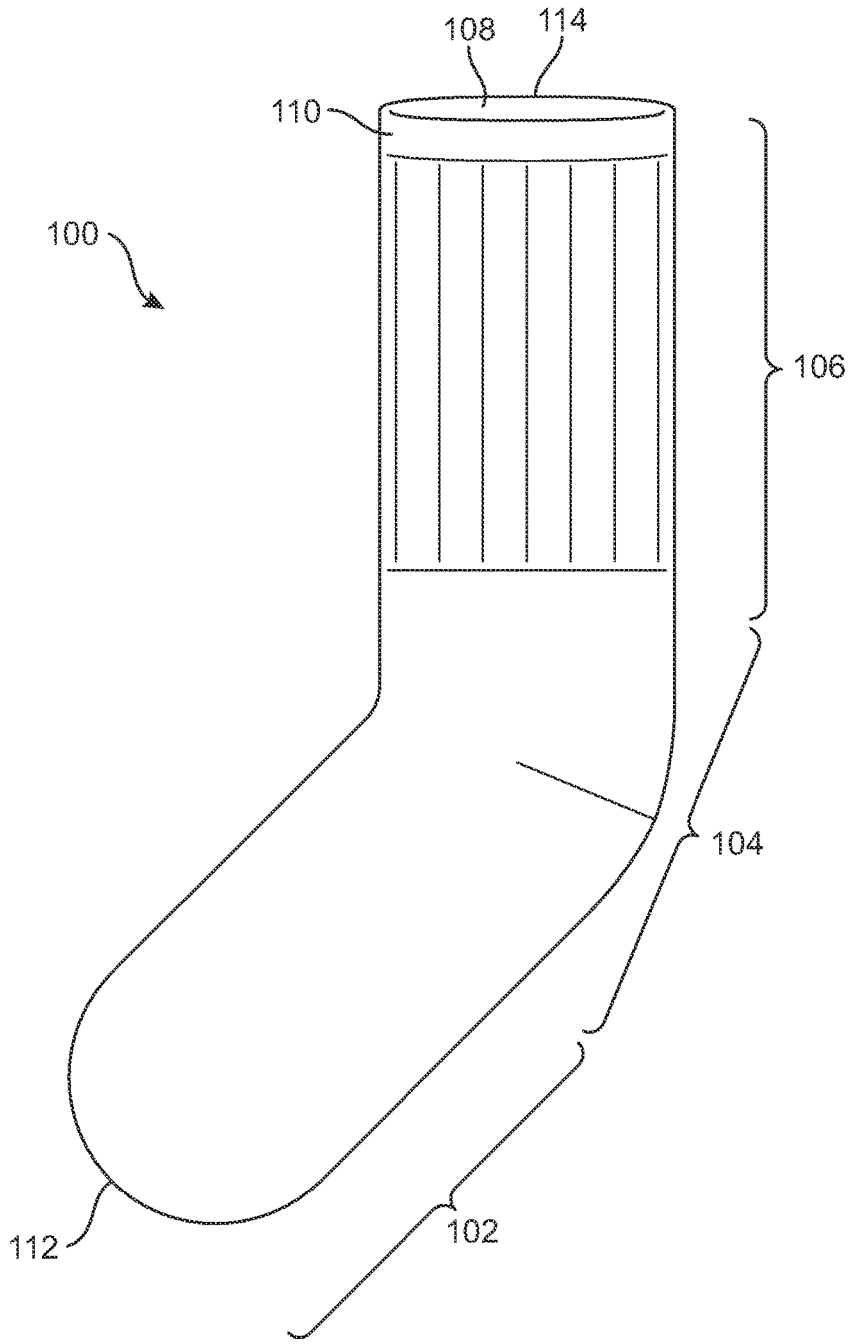
FIG. 1 is a plan view of an exemplary embodiment of an article of apparel in the form of a sock.

The embodiments can include provisions for consistent and accurate placement of articles on a receptacle. In one aspect, a method for placing a frame within an article includes associating a frame with a receptacle. The frame includes a first end and a second end and the receptacle includes a first end and a second end. The frame is aligned with the receptacle such that the frame contacts the receptacle along at least one side of the frame. The first end of the frame is oriented toward the first end of the receptacle and the second end of the frame is oriented toward the second end of the receptacle. An article is placed around the receptacle and the frame such that a first end of the article is oriented toward the first end of the receptacle and a second end of the article is oriented toward the second end of the receptacle. The first end of the article is grasped at a grasping portion and the grasping portion is associated with the first end of the frame. The frame and article are removed from the receptacle by pulling the article and the frame at the grasping portion.

In another aspect, a frame for accepting an article includes a first side, a second side, and a head portion. The head portion is located in a first end of the frame. The first side extends from the head portion toward a second end of a frame and the second side extends from the head portion toward the second end. The first side includes a first foot and the second side includes a second foot. The first foot and the second foot are located on the second end of the frame. The first foot extends toward the second side and the first end. The second foot extends toward the first side and the first end. The first foot is located in the same plane as the second side and the second foot is located in the same plane as the first side.

In another aspect, a system for retaining and transferring an article via an article frame includes a frame and a receptacle configured to accept the frame such that the frame is in a fixed orientation with respect to the receptacle. The receptacle is configured to accept the article while the frame is in a fixed orientation with respect to the receptacle. The frame and the article are removed from the receptacle while retaining the article in a fixed relation to the frame.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

The following discussion and accompanying figures disclose a variety of concepts related to retaining and transferring of an article of apparel. Although the concepts discussed may be utilized with a variety of products, a sock is disclosed as an example. In addition to socks, the concepts below may be utilized on other types of apparel (e.g., shirts, pants, jackets, undergarments), athletic equipment (e.g. baseball and football gloves, soccer ball restriction structures), containers (e.g. backpacks, bags), and upholstery for furniture (e.g. couches, car seats). Accordingly, the concepts disclosed herein may be incorporated with a variety of products for both personal and industrial purposes.

Figure 2:
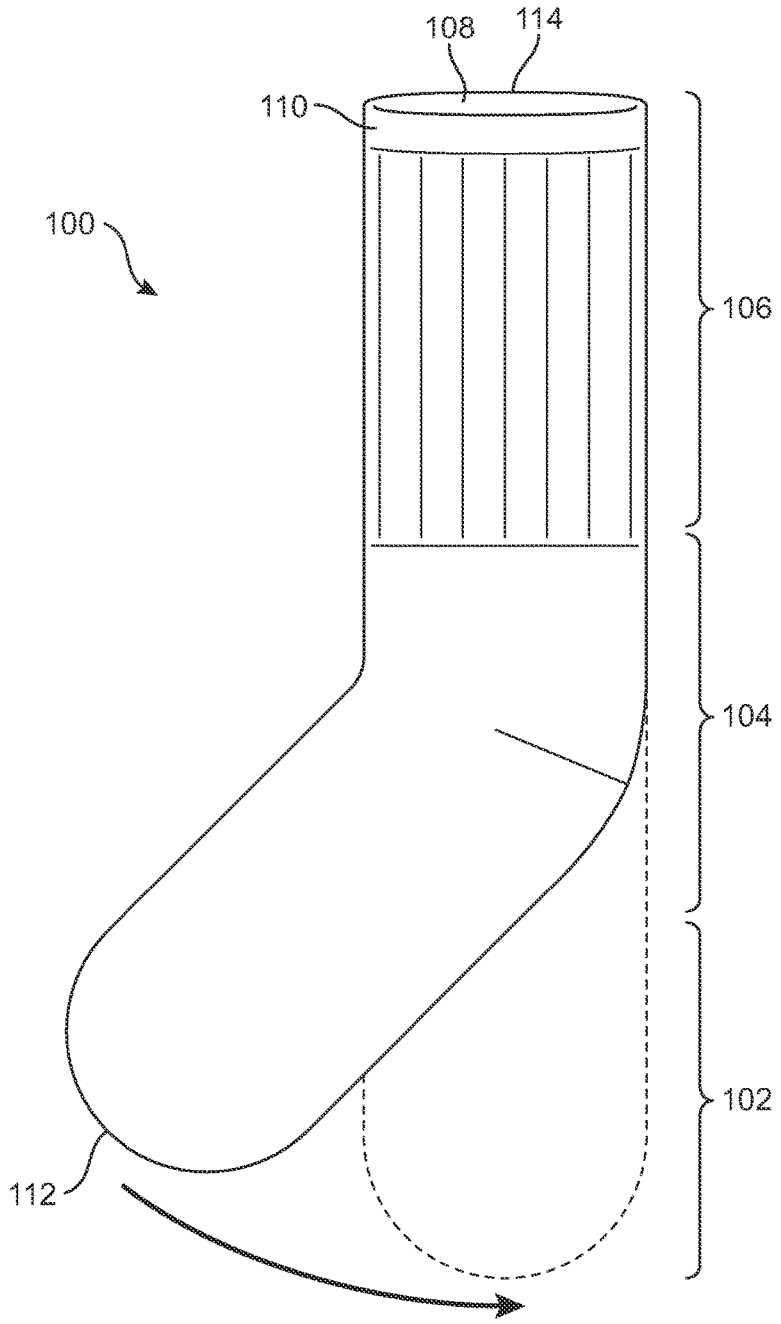
FIG. 2 is a plan view of an exemplary embodiment of an article of apparel being subjected to a force.

FIGS. 1-2 depict a plan view of an embodiment of an article of apparel 100, also referred to simply as article 100. In some embodiments, article of apparel 100 may take the form of a sock. In some embodiments, the sock could be a knitted sock. In other embodiments, article 100 could take the form of any other kind of apparel, including but not limited to: gloves, shirts, pants, scarves, hats, jackets, as well as other articles. In some embodiments, the article could be another type of article including, but not limited to: bags, purses, backpacks as well as other articles that may or may not be worn. Additionally, portions of articles of apparel may be included such as the arm portion of a shirt or the leg portion of pants as well as other portions of different articles of apparel. Alternatively, in some embodiments, the provisions described herein could be used with articles of footwear. For example, the embodiments discussed below could be used with the upper of an article of footwear, a bootie and/or another component of an article of footwear.

As depicted, article 100 may include a forefoot portion 102, a heel portion 104, and an entrance portion 106. The dimension of each portion is not meant to be a precise demarcation of the areas within article 100. Rather, forefoot portion 102, heel portion 104, and entrance portion 106 are intended to represent general areas of article 100 to aid in the following discussion.

Article 100 may include an interior surface 108 and an exterior surface 110. Article 100 may form a void for receiving a foot. Additionally, article 100 may have a first end 112 and a second end 114. In some embodiments, first end 112 is a closed end. In other embodiments first end 112 may be open. In an exemplary embodiment, first end 112 may be closed and second end 114 may be open.

Article 100 may be augmented as shown in FIG. 2. In FIG. 2 the forefoot portion 102 of article 100 may be bent or augmented to align with the dotted line such that the forefoot portion 102 may be located largely within the same plane as entrance portion 106 of article 100. In some embodiments, article 100 may be bent in the area of heel portion 104 in order to align the forefoot portion 102 with the entrance portion 106 of article 100. In some embodiments, the heel portion 104 of article 100 may create a bulge in article 100 when the article 100 is augmented as depicted in FIG. 2.

Figure 3:
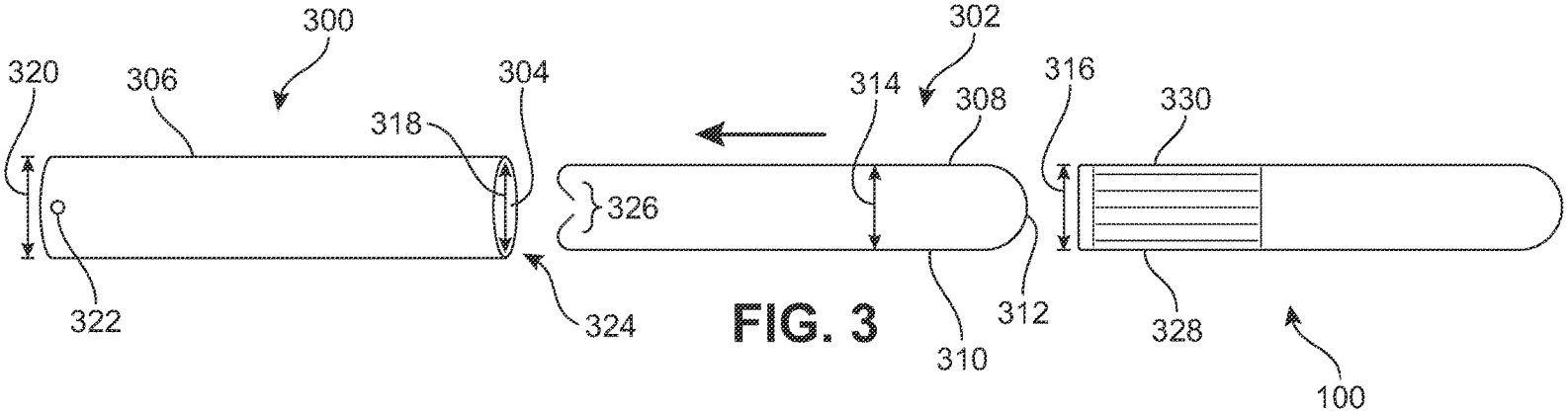
FIG. 3 is a top view of an exemplary embodiment of a receptacle, frame and article of apparel.

FIG. 3 illustrates pieces that may be utilized in retaining and transferring an article. Some embodiments may include provisions for securing an article in place. The embodiment shown includes a receptacle 300, a frame 302 and article 100. In some embodiments, receptacle 300 may be used to facilitate printing onto an article of apparel, such as article 100. In some embodiments, receptacle 300 comprises a tube-like structure. In particular, in some cases, receptacle 300 may have an approximately cylindrical shape. Other embodiments, however, may utilize receptacles with rectangular cross-sectional shapes, triangular cross-sectional shapes, regular cross-sectional shapes, irregular cross-sectional shapes, as well as any other kinds of cross-sectional shapes.

Receptacle 300 may be constructed with different properties. For example, in some embodiments, receptacle 300 may be a hollow structure. In other embodiments, receptacle 300 may be a solid structure. In some embodiments, a portion of receptacle 300 may be hollow and a portion of receptacle 300 may be solid. In the embodiment shown in FIG. 3, receptacle 300 is hollow.

In the embodiment shown in FIG. 3, receptacle 300 includes opening 324. In some embodiments, receptacle 300 also includes an interior surface 304 and an exterior surface 306. In some cases, exterior surface 306 may contact portions of an article that is placed over receptacle 300, such as article 100. In addition, in some cases, interior surface 304 may contact retaining features, such as frame 302.

Frame 302 may be constructed to interact with receptacle 300. In some embodiments, frame 302 may include a first side 308, a second side 310, and a head portion 312. Some embodiments may include foot portions 326, discussed later in the description.

In some embodiments, frame 302 is solid from first side 308 to second side 310. In other embodiments, frame 302 may include spaces between each side. In some embodiments, frame 302 may be a wire-type, such that the interior of the frame is open. Head portion 312 may generally have the shape of a half-circle; however, multiple shapes of head portion 312 may be possible. First side 308 and second side 310 may extend from head portion 312 in a generally straight, even manner. In some embodiments, first side 308 and second side 310 may comprise different shapes as discussed later in the description. Foot portions 326 may include curved portions discussed later in the description.

The dimensions of article 100 and frame 302 may vary and in some cases may be selected so that article 100 fits over frame 302. In some embodiments of frame 302, the distance 314 of frame 302 from first side 308 to second side 310 may correspond to the distance 316 from an edge 328 to an edge 330 of article 100. Distance 316 of article 100 may correspond to the width of article 100 in a natural state (e.g., a state where no external/internal forces are applied to article 100). In some embodiments, article 100 may include a void for accepting a foot, for example. In embodiments in which article 100 includes a void, distance 316 of article 100 may correspond to the distance from side to side of article 100 when article 100 is laid flat or is largely in a two-dimensional orientation. That is, the void within article 100 may be inaccessible to a foot when article 100 is laid flat. In some embodiments distance 314 of frame 302 may be slightly larger than distance 316 of article 100 such that article 100 may be stretched in order to fit over frame 302.

The dimensions of frame 302 and receptacle 300 may vary and in some cases the dimensions may be selected so that frame 302 fits over or within receptacle 300. In some embodiments distance 314 of frame 302 may correspond to distance 318 of receptacle 300. Distance 318 may be the inside diameter of receptacle 300. In some embodiments, distance 314 of frame 302 may be slightly larger than distance 318. Such an embodiment may allow frame 302 to be fit within receptacle 300. In other embodiments, distance 314 may correspond to distance 320 of receptacle 300. Distance 320 may correspond to the outside diameter of receptacle 300. Such an embodiment may allow frame 302 to wrap around receptacle 300. In some embodiments, distance 314 of frame 302 may be slightly smaller than distance 320 of receptacle 300. Such a configuration allows for frame 302 to be inserted into receptacle 300.

In some embodiments, frame 302 may be substantially elastic. For example, in some embodiments, the elastic properties of frame 302 may be selected to allow first side 308 and second side 310 to be squeezed together. In another embodiment, the elastic properties of frame 302 may be selected so that first side 308 and second side 310 can move towards one another, but may remain spaced apart. Still other embodiments may use a relatively rigid frame 302, such that first side 308 and second side 310 may not be moved relative to one another (e.g., squeezed together or separated). Furthermore, in at least some embodiments, frame 302 may have an elasticity that is greater than the elasticity of receptacle 300 such that frame 302 can be bent, or otherwise elastically deformed, without any substantial bending or deformation of receptacle 300. This may allow, for example, frame 302 to be slightly squeezed to fit within opening 324 of receptacle 300 and/or slightly expanded to fit around exterior surface 306 of receptacle 300.

In different embodiments, the materials used in constructing frame 302 could vary. Exemplary materials include, but are not limited to: steel, aluminum, plastic, rubber or other materials or a combination thereof. In some embodiments frame 302 may be constructed of metal. In some embodiments frame 302 may be constructed of a metal wire. Additionally, in some embodiments, an elastic material, such as rubber may be used. The shape and design of frame 302 will be discussed in further detail later in the description. Moreover, it will be understood that in at least some embodiments the materials used in constructing frame 302 could be selected to achieve desired properties such as a desired elasticity and/or rigidity for frame 302.

Figure 4:
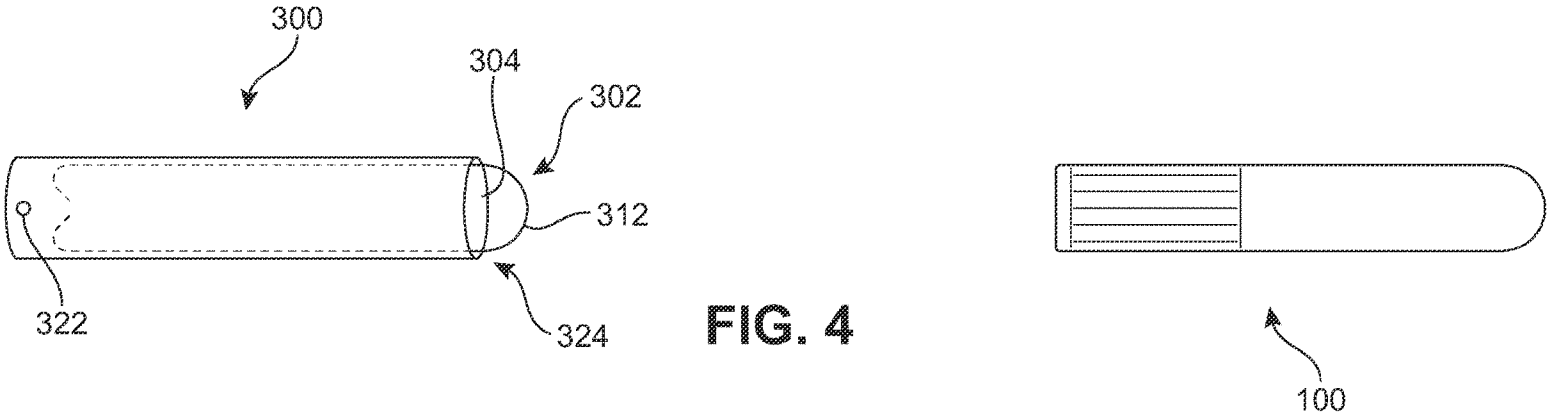
FIG. 4 is a top view of an exemplary embodiment of a frame within a receptacle and an article of apparel.

Referring to FIG. 4, frame 302 may be inserted into receptacle 300. In some embodiments, frame 302 may be inserted through opening 324. In some embodiments, receptacle 300 may include provisions for retaining frame 302 in a fixed position relative to receptacle 300. In some embodiments, for example, frame 302 may interact with interior surface 304. Specifically, in some cases, first side 308 and second side 310 of frame 302 may exert pressure onto interior surface 304. In such cases, the pressure exerted by frame 302 may allow frame 302 to remain in a fixed position relative to receptacle 300.

Figure 14:
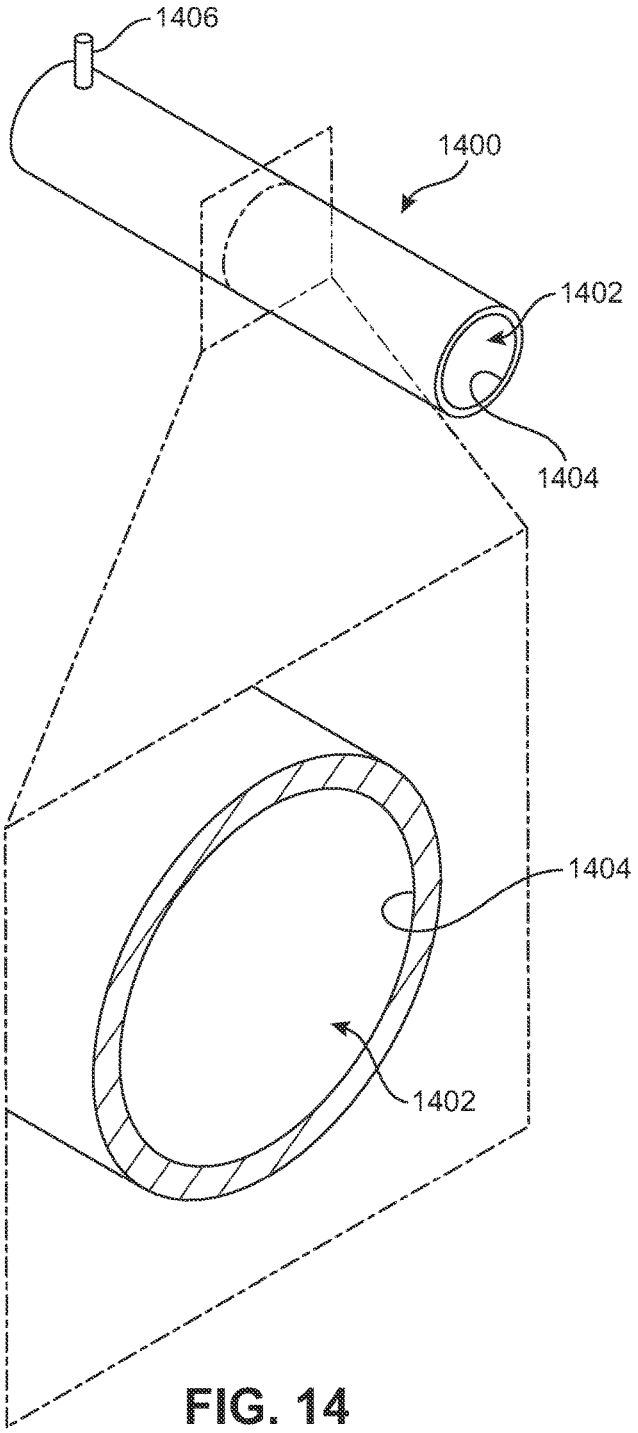
FIG. 14 is an isometric view of an embodiment of a receptacle.

In some embodiments a stop 322 may be incorporated in receptacle 300 (see also stop 1406 of FIG. 14). In some embodiments, receptacle 300 may interact with a separate stop 322 while in other cases stop 322 may be integrally formed with receptacle 300. In some embodiments, stop 322 may be used to secure receptacle 300 in a fixed location. In some embodiments, frame 302 may interact with stop 322. In such cases, foot portions 326 of frame 302 may press against stop 322 within receptacle 300. This action may limit the movement of frame 302 within receptacle 300. As such, frame 302 may be inserted to a precise distance such that the frame 302 is not pushed too far within receptacle 300.

As illustrated in FIG. 4, in some embodiments upon being fully inserted into receptacle 300, head portion 312 of frame 302 may extend through opening 324, beyond the length of receptacle 300. Head portion 312 may extend beyond opening 324 by different lengths. The length that head portion 312 extends beyond the opening 324 may be influenced by the length of first side 308 and second side 310. The longer the sides, the further head portion 312 may extend beyond opening 324. In some embodiments, the entire length of first side 308 and the second side 310 may be inserted into receptacle 300. In other embodiments, a portion of the sides may extend beyond opening 324 of receptacle 300. Additionally, the geometry of head portion 312 may determine the length that head portion 312 extends beyond opening 324. In the embodiment shown in FIG. 4, head portion 312 is shaped in a substantially circular manner such that the diameter of the circle is approximately distance 314. The length that head portion 312 extends beyond opening 324 is approximately half of the diameter of the circle (or half of distance 314) that head portion 312 creates. In other embodiments, the curvature of head portion 312 may be more gradual, such that distance 314 does not correlate to, and is smaller than, the diameter of head portion 312. In such a case, the distance that head portion 312 extends beyond opening 324 may be less than the distance that a head of smaller diameter may extend beyond opening 324.

While the exemplary embodiment depicts a generally rounded head portion 312, in other embodiments a head portion for a frame could have any other shape. In an alternative embodiment, for example, a head portion may have a triangular shape. Such variations in geometry may affect how far the head portion extends from a receptacle. For example, a triangular shaped head may extend further than other shapes.

Figure 5:
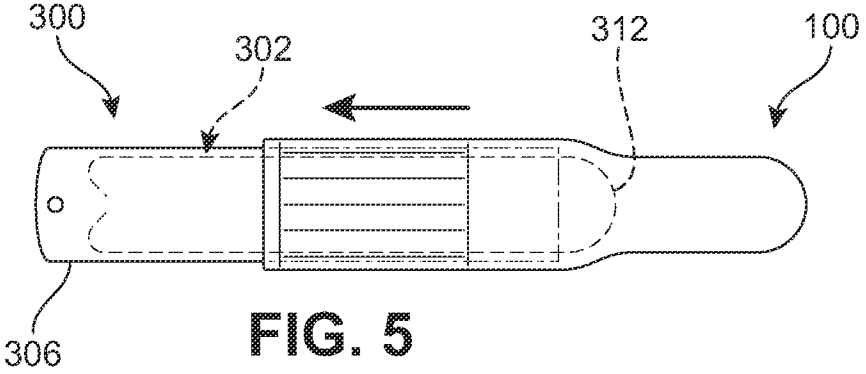
FIG. 5 is a top view of an exemplary embodiment of a partial portion of an article of apparel over a frame and receptacle.
Figure 6:
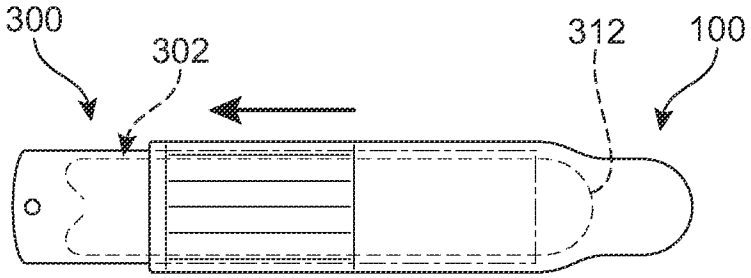
FIG. 6 is a top view of an exemplary embodiment of a partial portion of an article of apparel over a frame and receptacle.
Figure 7:
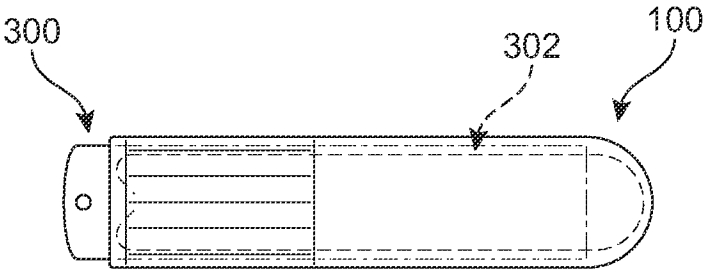
FIG. 7 is a top view of an exemplary embodiment of an article of apparel over a frame and receptacle.

Referring to FIGS. 5-7, article 100 is shown being placed around receptacle 300 and frame 302. In some embodiments article 100 may be expanded in order to fit around receptacle 300. In some embodiments, the interior surface 108 (see FIG. 1) of article 100 may contact the exterior surface 306 of receptacle 300. In some embodiments, article 100 may extend the full length of receptacle 300, in which substantially the entirety of interior surface 108 of article 100 may contact receptacle 300. In other embodiments, article 100 may extend along a portion of receptacle 300 in which a portion of the interior surface 108 of article 100 may contact the exterior surface 306 of receptacle 300.

Frame 302 may interact with article 100 in varying degrees. In some embodiments the head portion 312 of frame 302 may interact with the interior surface of article 100. In other embodiments, first side 308 and second side 310 of frame 302 may also interact with the interior surface 108 of article 100. In some embodiments, the interior surface 108 of article 100 may be simultaneously in contact with the exterior surface 306 of receptacle 300, the first side 308 and second side 310 of frame 302, as well as head portion 312 of frame 302 in one position. In other embodiments, the interior surface 108 of article 100 may contact one or more of the exterior surface 306, first side 308, second side 310, and head portion 312 in another position.

FIG. 5 and FIG. 6 depict article 100 in different locations as article 100 is pulled over receptacle 300. In FIG. 5, about half of article 100 is pulled over receptacle 300, and in FIG. 6 about three-quarters of article 100 is pulled over receptacle 300. FIG. 7 shows article 100 in a final position on receptacle 300. As seen in FIG. 7, in a final position of article 100 on receptacle 300, some portions of receptacle 300 may still remain uncovered by article 100.

With article 100 positioned over receptacle 300, article 100 in FIG. 7 may be in a position to accept a printing material. Printing material as used throughout the detailed description may refer to various different kinds of printing materials, such as inks, dyes, other colorants, as well as various kinds of polymer materials that are commonly used in additive manufacturing processes. In some embodiments, printing material may be used to show a graphic, image or other visual effect. In other embodiments logos may be created using printing material. In some embodiments, printing material may be required to dry or cure. In some embodiments, the printing material may require other procedures in order to secure or preserve the printing material in a specific location.

Figure 8:
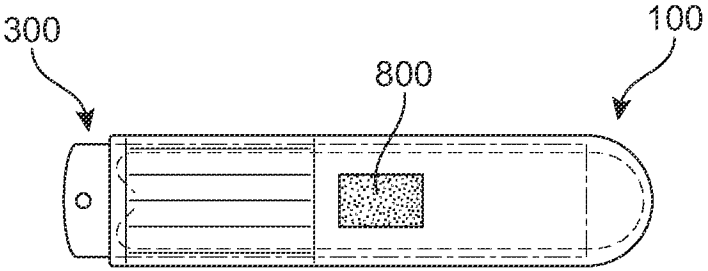
FIG. 8 is a top view of an exemplary embodiment of an article of apparel over a frame and receptacle with a printed portion.

FIG. 8 illustrates a printed portion 800 on article 100. Printed portion 800 may be created by various techniques and use a printing material as discussed above. Printed portion may be located in the forefoot portion 102, heel portion 104 or entrance portion 106 of article 100. The printed portion 800 may be various shapes and sizes. In some embodiments printed portion 800 is a logo, design or lettering. Further, printed portion may be located along different axial portions of article 100.

In order to apply printed portion 800, in some embodiments an article may be associated with a printing system while on a receptacle. In some embodiments, for example, receptacle 300 may be received by a printing system that applies printing material to portions of article 100 by placing the portions near a print head. Such placement could be achieved by translating and/or rotating receptacle 300 (and thus article 100) relative to the print head. That is, article 100 may be rotated and/or translated while on receptacle 300 in order to allow for printing material to be deposited at different locations on article 100. The embodiments described herein can make use of any of the systems and/or methods for printing to an article as disclosed in Ernst, U.S. Pat. No. 9,102,167 now U.S. patent application Ser. No. 14/094,946 filed Dec. 3, 2013, the entirety of which is hereby incorporated by reference.

Figure 9:
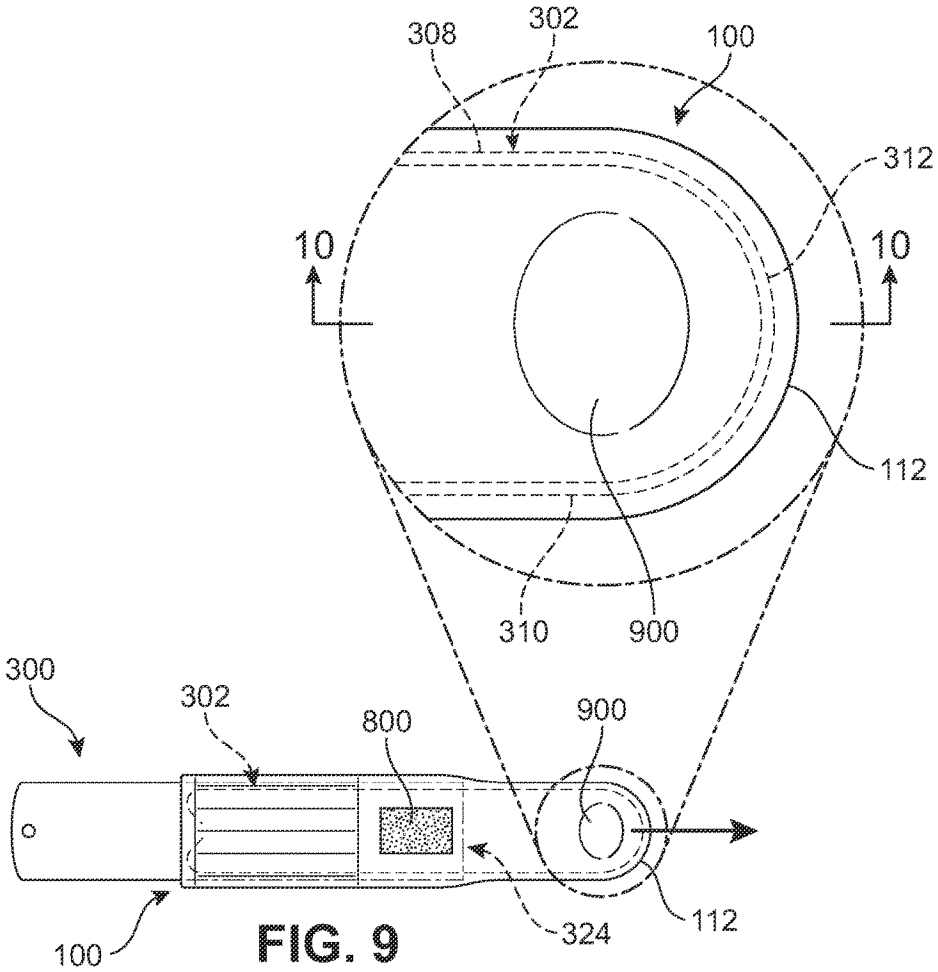
FIG. 9 is a top enlarged view of an exemplary embodiment of an article of apparel and frame being removed from a receptacle.

Following printing to article 100, it may be desirable to remove article 100 from receptacle 300 in a manner that limits contact with printed portions (e.g., printed portion 800). FIG. 9 depicts article 100 with printed portion 800 as it is removed from receptacle 300. In some embodiments, a force is applied to frame 302. In other embodiments, a force is applied to article 100. In further embodiments, a force is applied that interacts with both frame 302 and article 100. In some embodiments, a force may be applied at a grasping portion 900. In an exemplary embodiment, grasping portion 900 is located in forefoot portion 102. The force located at grasping portion 900 may generally pull the article 100 and frame 302 away from opening 324 of receptacle 300. In some embodiments, grasping portion 900 may be located at a position such that frame 302 is located between grasping portion 900 and first end 112 of article 100. In other embodiments, grasping portion 900 may be located in other areas with respect to article 100 and frame 302.

Grasping portion 900 is not meant to demarcate a precise location of article 100 and/or frame 302, rather grasping portion 900 represents a general area at which a user may interact with article 100 and frame 302. For purposes of illustration the boundary of grasping portion 900 is clearly visible in FIG. 9. In an exemplary embodiment, however, grasping portion 900 may not be clearly defined by any markings and instead may be implicitly defined as being between the edges of the frame 302 and article 100. In other embodiments, however, an article can be configured with markings to visibly indicate the approximate location of grasping portion 900. A user or machine may interact with frame 302 and article 100 in the general area as depicted in FIG. 9.

Further, FIG. 9 includes an enlarged isometric view depicting grasping portion 900. Grasping portion 900 may be of varying sizes and shapes. Further, grasping portion 900 may be located closer to first end 112 as well as further away from first end 112 than depicted. As shown, grasping portion 900 is located in between first side 308 and second side 310 of frame 302. Further, grasping portion 900 may be located in an area that is close to head portion 312 of frame 302. In some embodiments grasping portion 900 may be located along part of head portion 312 of frame 302.

Figure 10:
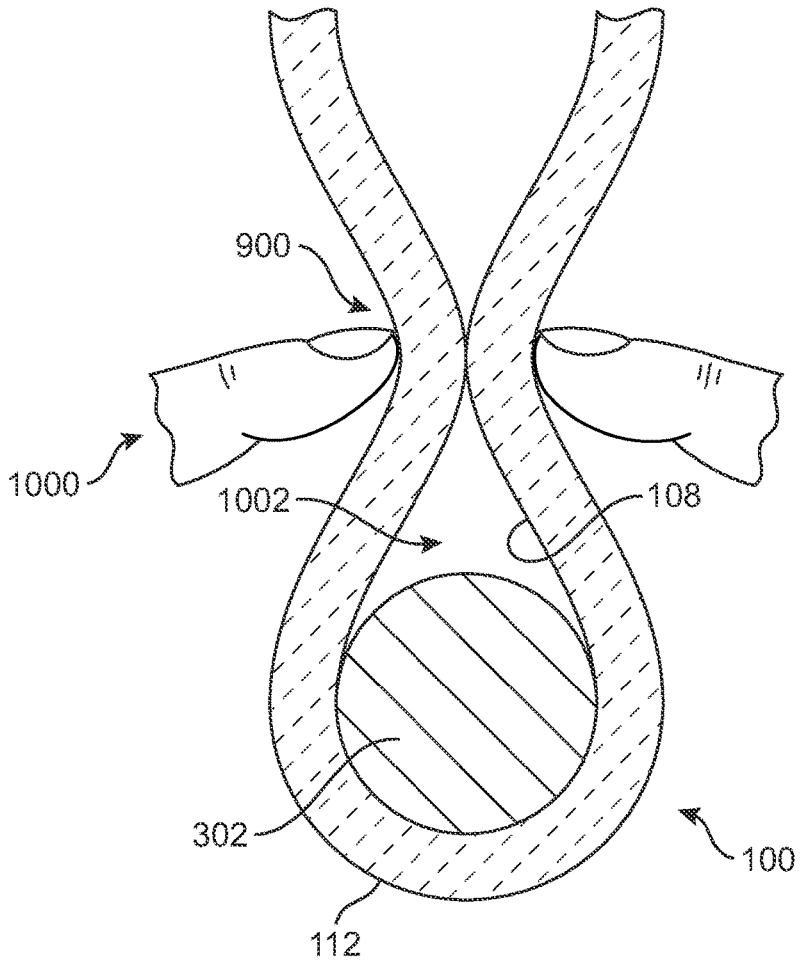
FIG. 10 is an enlarged cross-sectional representation of an embodiment of a grasping portion of an article of apparel and a frame.

Referring to FIG. 10, a sectional view of the grasping portion 900 depicted in FIG. 9 is shown. Force may be applied along grasping portion 900. In some embodiments, force may be applied by a machine. In an exemplary embodiment, force is applied by fingers 1000. In FIG. 10, fingers 1000 press together at grasping portion 900. In the embodiment shown, two sides of interior surface 108 of article 100 are brought together.

In some embodiments, there may be a gap 1002 or space between grasping portion 900 and frame 302. In some embodiments, the gap may be smaller than depicted in FIG. 10. In other embodiments, gap 1002 may be smaller. In still further embodiments, gap 1002 may not exist. In the case in which no gap exists, grasping portion 900 may be located at least partially on frame 302. That is, two sides of interior surface 108 of article 100 may be pressed toward frame 302 by the applied force.

After article 100 is grasped, article 100 and frame 302 may be removed from receptacle 300. In some embodiments, a force may be exerted in a direction of first end 112 of article 100. In some cases, fingers 1000 may slide while exerting a force toward first end 112 of article 100. In those cases, the gap 1002 may shrink in size and area. In some embodiments, fingers 1000 may slide such that the grasping portion 900 encounters frame 302 when force is exerted toward first end 112 of article 100. In other embodiments, grasping portion 900 may maintain its relationship with frame 302 while force is exerted toward first end 112 of article 100. Force may be exerted on to article 100 and frame 302 such that both article 100 and frame 302 are removed from contact with receptacle 300.

Figure 11:
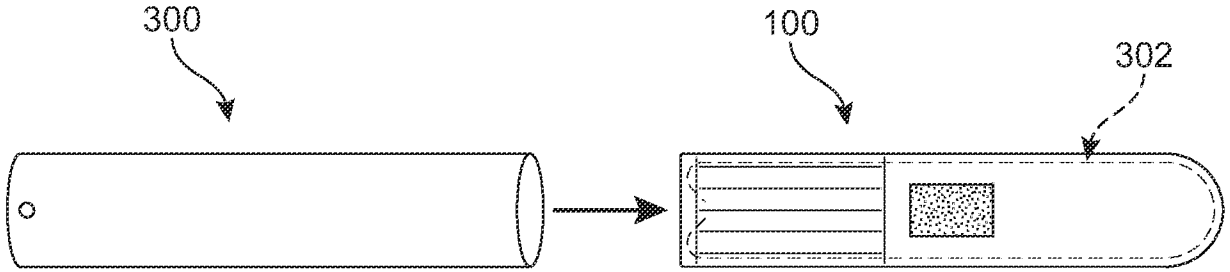
FIG. 11 is a top view of an exemplary embodiment of an article of apparel and frame removed from a receptacle.

FIG. 11 shows article 100 and frame 302 removed from receptacle 300. In some embodiments, frame 302 may be longer than article 100. In further embodiments, frame 302 and article 100 may be of similar length. In still further embodiments, frame 302 may be of shorter length than article 100. As shown in FIG. 11, frame 302 and article 100 are of similar lengths.

In some embodiments, frame 302 may interact with interior surface 108 (see FIG. 10) of article 100. Frame 302 may exert a force in a radial manner along interior surface 108 of article 100. In some embodiments, frame 302 may provide stability or support to article 100. As shown in FIG. 11, frame 302 interacts with interior surface 108 of article 100. The contact that interior surface 108 has with frame 302 may allow for article 100 to conform, or adhere to the shape of frame 302, which may provide stability to article 100.

In some embodiments frame 302 may slightly stretch article 100. In those embodiments article 100 may have less sag or loose portions than in other embodiments. Additionally, frame 302 may deform or shape article 100 such that article 100 is positioned in a substantially planar configuration.

Figure 12:
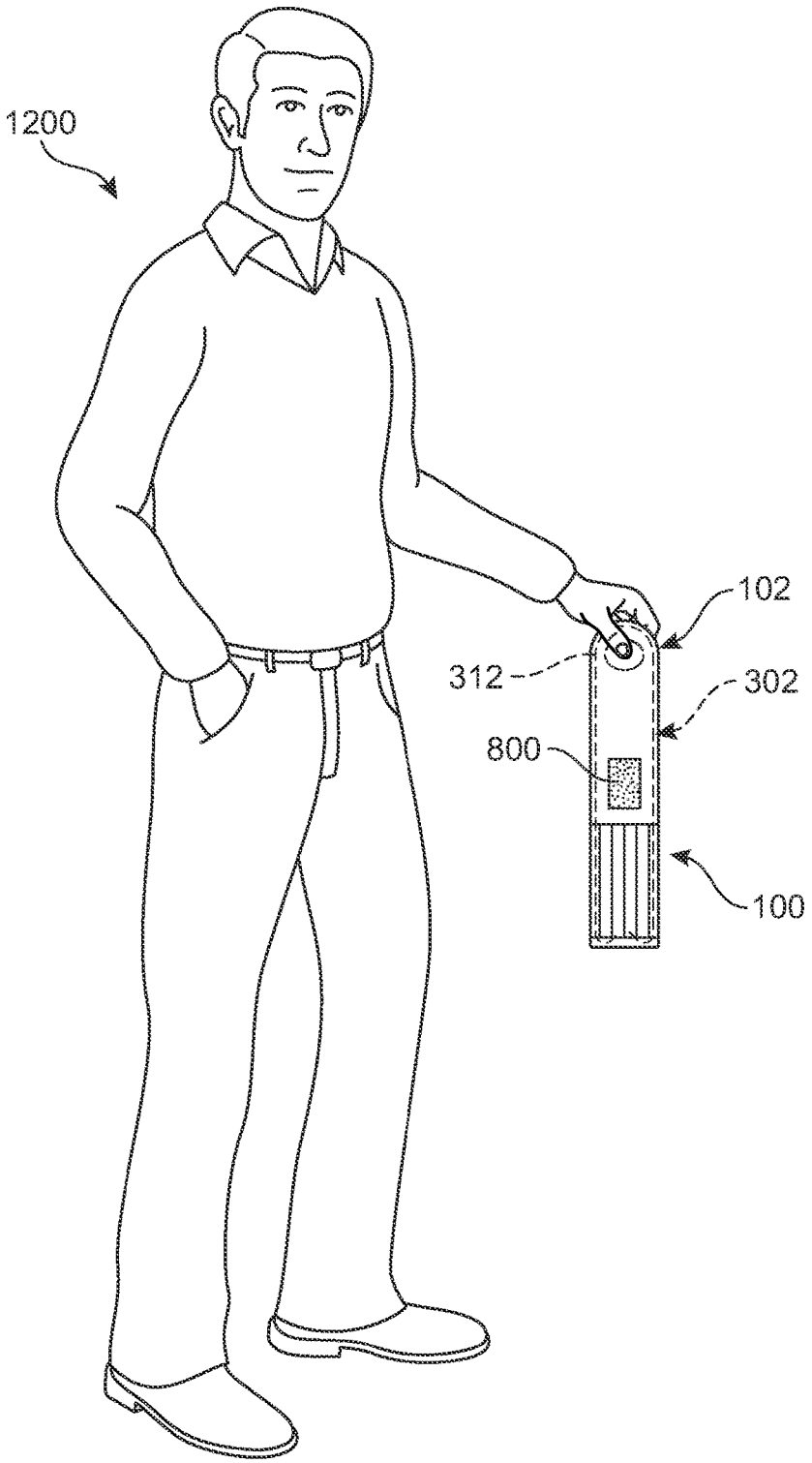
FIG. 12 is a depiction of a user holding a frame and an article of apparel in a downward position.
Figure 13:
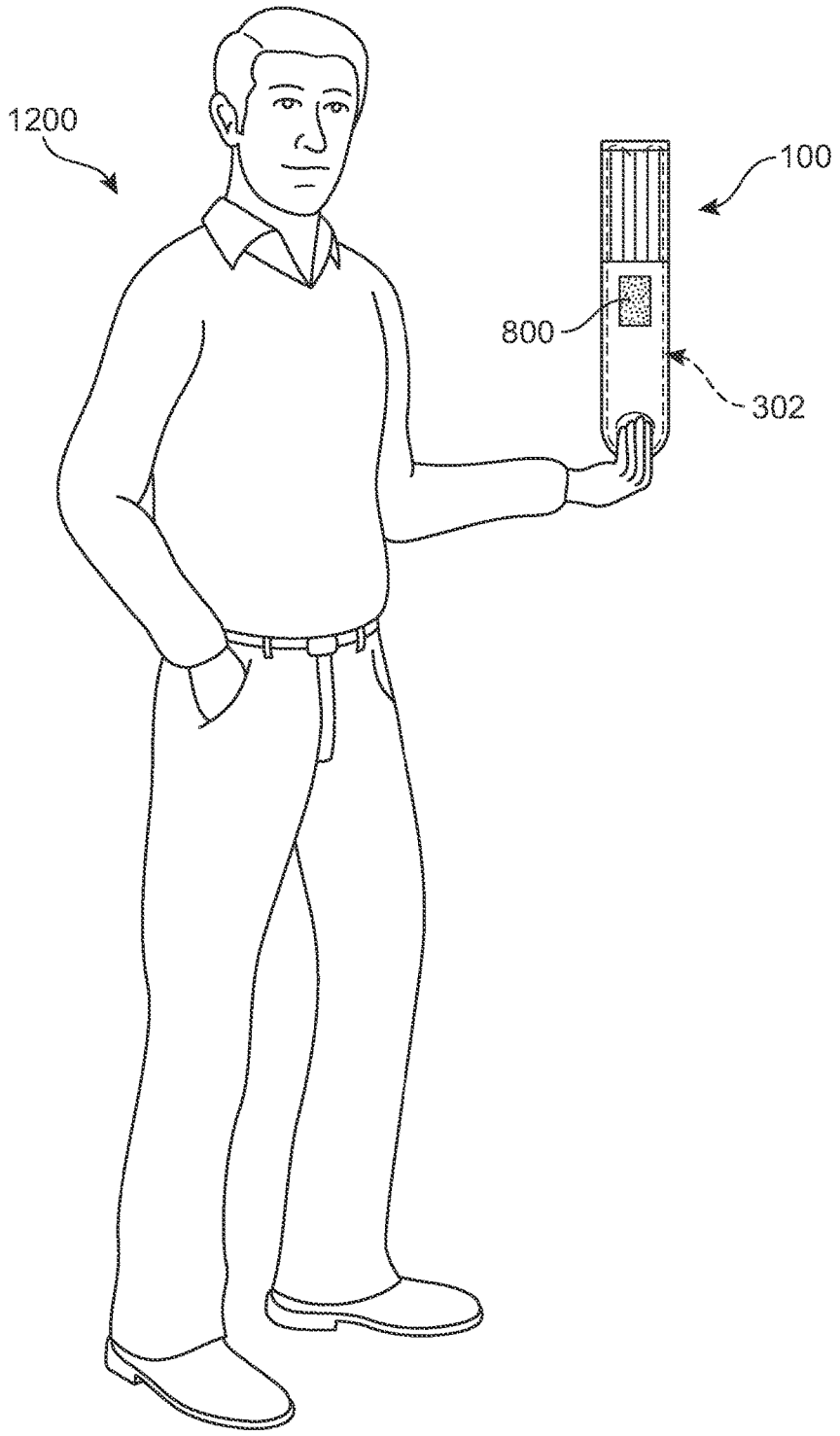
FIG. 13 is a depiction of a user holding a frame and an article of apparel in an upward position.

FIGS. 12 and 13 illustrate schematic views of a user holding frame 302 with article 100, in order to clearly illustrate the stable configuration of article 100 on frame 302. FIG. 12 depicts a user 1200 holding the combination of frame 302 and article 100. In the FIG. 12, user 1200 is holding frame 302 and article 100 in the area of forefoot portion 102 of article 100 and head portion 312 of frame 302. Article 100 may be relatively stable in this position. Printed portion 800 may be a distance away from the fingers of user 1200 such that material from printed portion 800 does not interact with user 1200. Further, in the position shown, article 100 may be in a taut position, such that exterior portions of article 100 may be limited in the ability to rub against each other. As such, frame 302 and article 100 may be transported with relative ease.

FIG. 13 depicts user 1200 holding the combination of frame 302 and article 100 in an upright position. Similarly to the depiction in FIG. 12, article 100 may in a relatively stable position. As depicted, article 100 and frame 302 may be moved with relative ease. Further, the stable frame 302 and article 100 combination may lessen the likelihood that user 1200 may accidentally interact with printed portion 800. The taut position created by frame 302 within article 100 may prevent article 100 from sliding along frame 302. The taut position may also limit the exterior portions of article 100 from rubbing printed portion 800.

With the stable configuration for article 100 provided by frame 302, article 100 may be easily transported to locations away from a printer. In some cases, article 100 may be transported in order to receive customization or further alterations. In such cases, frame 302 within article 100 may assist in easy transport from one location to another while limiting unwanted interference via handling of article 100, rubbing of exterior portions of article 100, or other unwanted interactions, with printed portion 800.

The stable configuration for article 100 provided by frame 302 may further facilitate the boarding and packaging of article 100. For example, in some cases, article 100 may be boarded after receiving printed portion 800. Frame 302 may be removed from article 100 while article 100 is in a flat orientation. Once frame 302 is removed, article 100 may accept a board for packaging or display. In some cases, a board may be largely in the same orientation as article 100. As such, article 100 may be packaged or displayed with relative ease after receiving a printed portion 800.

FIGS. 14-17 illustrate embodiments of a receptacle. Specifically, FIGS. 14-17 illustrate various possible configurations for a receptacle, including different geometries and/or other provisions that facilitate the interaction of the receptacle with a frame.

Referring to FIG. 14 an embodiment of a receptacle 1400 is depicted. In this case, receptacle 1400 is a hollow cylinder including an opening 1402. As discussed above, receptacles may be of varying shapes and sizes. In some embodiments, receptacles may include provisions for securing a frame in relative position to the receptacle. In FIG. 14 the interior surface 1404 of receptacle 1400 may contact a frame. Friction between interior surface 1404 and the frame may keep the frame in relative position with respect to receptacle 1400. Further, a frame may interact with stop 1406 as discussed above. Receptacle 1400 may be able to accept a frame at many different orientations. A frame may be inserted such that it is aligned in a vertical or horizontal orientation with respect to receptacle 1400. Further, a frame may be oriented in any position between a horizontal and vertical orientation.

In some embodiments, a receptacle may include an aligning feature. In some cases, the aligning feature may be located on the interior surface of a receptacle. In other embodiments, a receptacle may include an aligning feature on the exterior surface. In some embodiments, the aligning feature may include additional material located on the interior surface of the receptacle. In other embodiments, the aligning feature may include a cut-out or groove within the interior surface of the receptacle. In still other embodiments, the aligning feature may include a cut-out or groove within the exterior surface of the receptacle.

Figure 15:
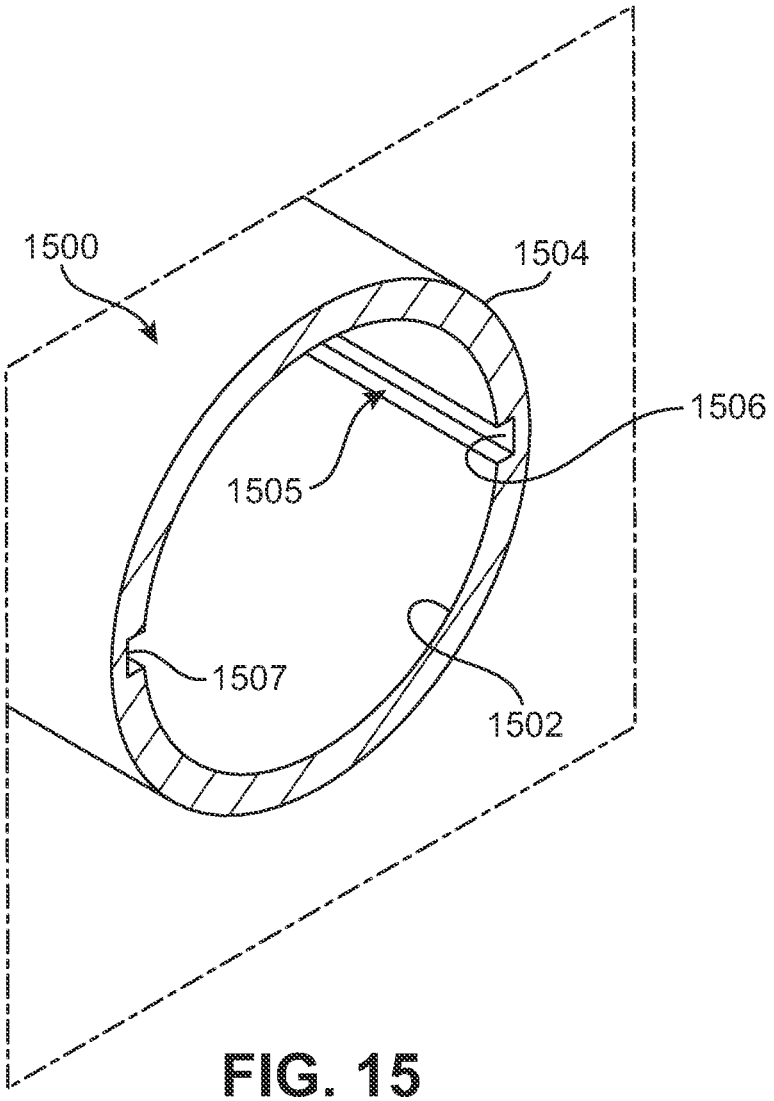
FIG. 15 is an cross-section isometric view of an alternate embodiment of a receptacle.

FIG. 15 depicts a cross-section of an alternate embodiment of a receptacle. Receptacle 1500 includes interior surface 1502, and exterior surface 1504. Like receptacle 1400, receptacle 1500 may be hollow. Receptacle 1500 additionally includes a pair of grooves 1505, also referred to simply as grooves 1505. Grooves 1505 comprise a first groove 1506 and a second groove 1507. In some embodiments, first groove 1506 and second groove 1507 may be oriented on opposing portions of receptacle 1500. Specifically, in some cases, first groove 1506 and second groove 1507 may be separated by an angular distance of 180 degrees around the circumference of receptacle 1500. Of course, in other embodiments, first groove 1506 and second groove 1507 could be positioned at any other relative angular positions around receptacle 1500.

In some cases grooves 1505 may interact with a frame. In some cases grooves 1505 may orient a frame in a fixed orientation with respect to receptacle 1500.

For purposes of clarity, the following description discusses first groove 1506, also referred to herein as simply groove 1506, in detail. However, it will be understood that the principles and features discussed for first groove 1506 may similarly apply to second groove 1507.

In different embodiments, the length of groove 1506 relative to receptacle 1500 may vary. In some embodiments, groove 1506 may extend along the entire length of receptacle 1500. In other embodiments, groove 1506 may extend a partial length of receptacle 1500.

In different embodiments, the geometry of groove 1506 could vary. In some embodiments, groove 1506 may be shaped in a similar manner to the edges of a frame. In other embodiments, groove 1506 may be shaped to accept a variety of frame shapes. In some cases, groove 1506 may be rectangular in shape for receiving a frame with a rectangular edge. It will be understood that in some embodiments, the geometry of a groove need not match the corresponding geometry of a frame. In some cases, for example, groove 1506 may be rectangular and may receive a frame having a circular or rounded edge.

In some embodiments, receptacle 1500 may include multiple pairs of grooves. For example, a pair of grooves may be aligned in a horizontal direction within receptacle 1500. Another pair of grooves may be aligned in a vertical direction within receptacle 1500. That is, there may be four grooves that are equally spaced within receptacle 1500. A frame may then be inserted into the horizontal pair of grooves, orienting the frame horizontally with respect to receptacle 1500. A frame may also be inserted into the vertical pair of grooves, orienting the frame vertically with respect to receptacle 1500. Many different pairs of grooves may be utilized to allow for a frame to be positioned in multiple fixed orientations.

In some embodiments, receptacle 1500 may include grooves that are not part of a pair. For example, receptacle 1500 may include three grooves that are equally spaced within receptacle 1500. An embodiment with three grooves in receptacle 1500 may accept a three-dimensional frame. In such an embodiment the frame may be a triangular prism. In other cases, four grooves may be utilized such that receptacle 1500 may accept a three-dimensional frame in the shape of a rectangular prism. Of course, different arrangements of grooves may accept frames of different geometries.

Figure 16:
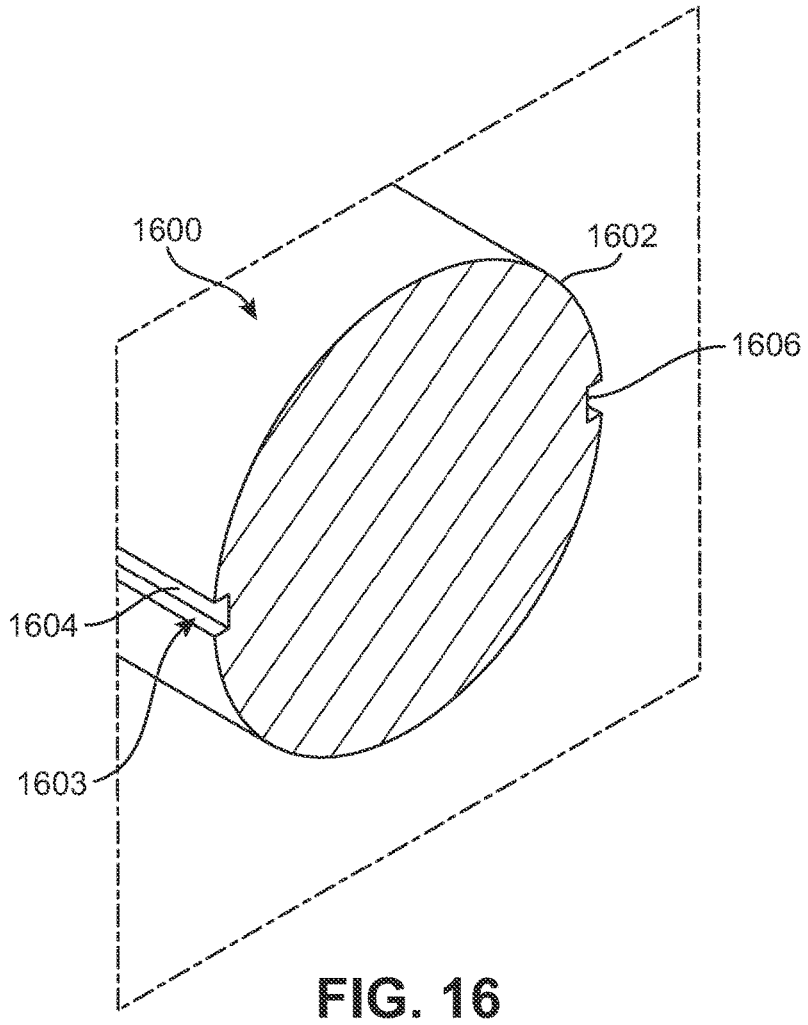
FIG. 16 is a cross-section isometric view of another alternate embodiment of a receptacle.

FIG. 16 depicts a cross-section of an alternate embodiment of a receptacle. Unlike receptacle 1400, receptacle 1600 may be a solid structure. Receptacle 1600 includes exterior surface 1602 and pair of grooves 1603, also referred to simply as grooves 1603. Grooves 1603 comprise a first groove 1604 and a second groove 1606. In some embodiments, first groove 1604 and second groove 1606 may be oriented on opposing portions of receptacle 1600. In some embodiments grooves 1603 may interact with a frame. In some cases groove 1603 may orient a frame in a fixed orientation with respect to receptacle 1600.

The variations described above with respect to groove 1506 of receptacle 1500 may be applied to groove 1604 and/or groove 1606 of receptacle 1600. That is, the variations of length, shape, orientation and number of grooves described with respect to receptacle 1500 may be applicable to receptacle 1600 as well.

Figure 17:
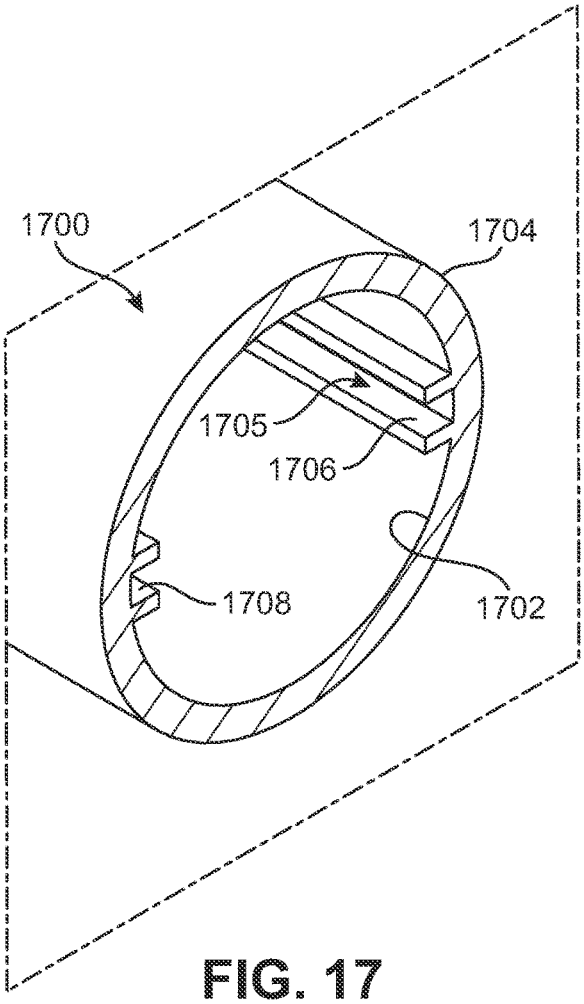
FIG. 17 is a cross-section isometric view of another alternate embodiment of a receptacle.

FIG. 17 depicts a cross-section of an alternate embodiment of a receptacle. Like receptacle 1400, receptacle 1700 may be hollow. Receptacle 1700 includes interior surface 1702, exterior surface 1704. Receptacle 1700 additionally includes pair of channels 1705, also referred to simply as channels 1705. Channels 1705 comprise a first channel 1706 and a second channel 1708. In some embodiments, first channel 1706 and second channel 1708 may be oriented on opposing portions of receptacle 1700. Specifically, in some cases, first channel 1706 and second channel 1708 may be separated by an angular distance of 180 degrees around the circumference of receptacle 1700.

For purposes of clarity, the following description discusses first channel 1706, also referred to herein as simply channel 1706, in detail. However, it will be understood that the principles and features discussed for first channel 1706 may similarly apply to second channel 1708.

In some embodiments, channel 1706 may be formed with additional material placed along interior surface 1702. The material may extend away from interior surface 1702 as shown in FIG. 17. In some cases, the additional material may form a channel-like structure. In some cases, channel 1706 may be formed of two parallel sides. In such a case, channel 1706 may appear as a U-shape in a cross-sectional view. In other embodiments, channel 1706 may be an enclosed structure. In such embodiments, channel 1706 may appear as a circular shaped opening. In other cases, channel 1706 may appear as a square or irregular shaped opening.

The variations described with respect to groove 1506 of receptacle 1500 may be applied to channel 1706 of receptacle 1700. That is, the variations of length, shape, orientation and number of grooves described with respect to receptacle 1500 may be applicable to the channels of receptacle 1600 as well.

Figure 18:
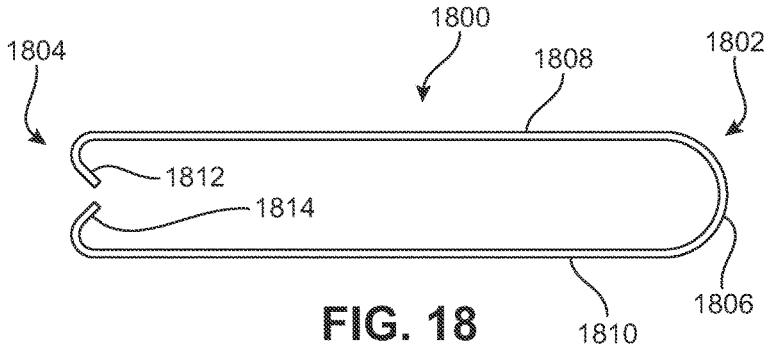
FIG. 18 is a view of an exemplary embodiment of a frame.

FIGS. 18-23 depict various embodiments of a frame. Referring to FIG. 18 frame 1800 is depicted. In some cases, frame 1800 may include a first end 1802 and a second end 1804. In some cases, first end 1802 may include a head 1806. In some cases, frame 1800 may include a first side 1808 and a second side 1810. First side 1808 may include a bent portion referred to as foot 1812. Second side may include a bent portion referred to as foot 1814.

In some cases, frame 1800 may be closed at second end 1804. In other cases, frame 1800 may be open at second end 1804. As shown, frame 1800 is open at second end 1804 and closed at first end 1802. In some embodiments, head 1806 may be rounded. In other cases, head 1806 may be in the form of other shapes. In some cases, first side 1808 may extend from head 1806 toward second end 1804. In some cases, second side 1810 may extend from head 1806 toward second end 1804. In some embodiments, first side 1808 and second side 1810 may run parallel to each other. In some embodiments, first side 1808 and second side 1810 may be straight, or unbent in appearance. In other embodiments, first side 1808 and second side 1810 may include bends or curves. In other embodiments, first side 1808 and second side 1810 may have a non-parallel relationship. That is, first side 1808 and second side 1810 may be shaped independently of one another.

In some embodiments, frame 1800 may be elastically deformable. In some embodiments frame 1800 may be created using metal. In some embodiments, frame 1800 may be created using a thin metal. Moreover, frame 1800 may be configured with various cross-sectional shapes in different embodiments. Exemplary cross-sectional shapes include, but are not limited to: square shapes, rectangular shapes, polygonal shapes, regular shapes as well as irregular shapes. In other embodiments, the cross-section of frame 1800 may be circular.

Referring to foot 1812, foot 1812 may be located near second end 1804 of frame 1800. In some embodiments, foot 1812 may extend from first side 1808. In some embodiments, foot 1812 may extend along the same plane as second side 1810 is located. In some embodiments, foot 1812 may extend partially to second side 1810.

In some cases, foot 1812 may bend from second end 1804 toward first end 1802. In some embodiments, foot 1812 may extend toward second side 1810. In some embodiments, foot 1812 may extend toward first end 1802 and second side 1810 of frame 1800.

In some embodiments, foot 1812 may be shorter in length than first side 1808. In other embodiments, foot 1812 may be longer than first side 1808. In some embodiments, while foot 1812 is shorter than first side 1808, foot 1812 may extend and interact with foot 1814. In other embodiments, foot 1812 may be shorter such that it does not interact with foot 1814.

Referring to foot 1814, foot 1814 may be located near second end 1804 of frame 1800. Foot 1814 may be located, shaped and sized in a similar manner to foot 1812, however, foot 1814 may be located on second side 1810 of frame 1800. In some embodiments, foot 1812 and foot 1814 may be shaped as mirror-images of one another.

In some embodiments, frame 1800 may be shaped and sized such that it may interact with a receptacle. In some embodiments, frame 1800 may interact with receptacle 1400, receptacle 1500, receptacle 1600 and/or receptacle 1700. Frame 1800 may interact with interior surface 1404 of receptacle 1400. In such a case, frame 1800 may be sized such that friction between frame 1800 and receptacle 1400 may keep frame 1800 in a fixed position relative to receptacle 1400. Further, frame 1800 may be placed in many orientations within receptacle 1400.

Frame 1800 may be sized such that it may interact with grooves 1505 of receptacle 1500. In such a case, grooves 1505 may hold frame 1800 in a pre-defined position. In other embodiments, frame 1800 may press against interior surface 1502 of receptacle 1500 and remain in a fixed relationship to receptacle 1500.

Frame 1800 may further interact with receptacle 1600. The feet of frame 1800 may interact with grooves 1603 of receptacle 1600. Further, the first side 1808 and second side 1810 of frame 1800 may interact with grooves 1603 or exterior surface 1602. As such, frame 1800 may be in a fixed relation to receptacle 1600.

In another case, frame 1800 may interact with receptacle 1700. First side 1808 and second side 1810 may interact with channels 1705. In such a case, frame 1800 may be in a pre-determined fixed relation with receptacle 1700. In other cases, frame 1800 may press against interior surface 1702 at other locations within receptacle 1700 and remain in fixed relation to receptacle 1700.

Figure 19:
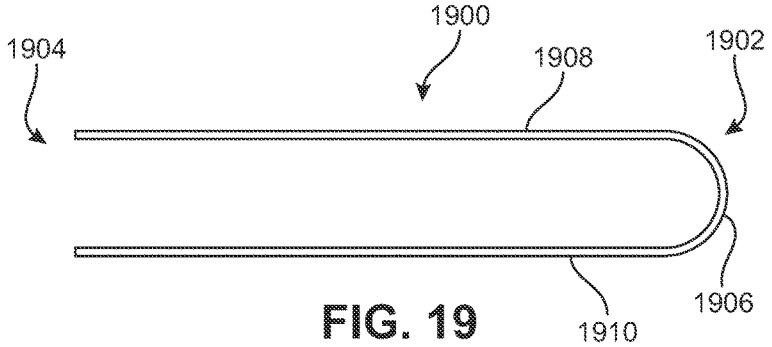
FIG. 19 is a view of an alternate embodiment of a frame.

Referring to FIG. 19 frame 1900 is depicted. In some embodiments, frame 1900 may include a first end 1902 and a second end 1904. In some embodiments, first end 1902 may include a head 1906. In some embodiments, head 1906 may be rounded in shape. In some cases, frame 1900 may include a first side 1908 and a second side 1910. In some cases, first side 1908 may extend toward second end 1904. In some cases, second side 1910 may extend toward second end 1904. In some embodiments, frame 1900 may be closed at second end 1904. In other cases, frame 1900 may be open at second end 1904. As shown, frame 1900 is open at second end 1904 and closed at first end 1902.

The variations of geometry, material, cross-sectional shape, and other aspects described with relation to frame 1800 are largely applicable to frame 1900. Further, the interactions between frame 1800 and the different embodiments of receptacles may be similar to the interactions of frame 1900 and the embodiments of the receptacles.

In contrast to frame 1800, frame 1900 may be straight or unbent at second end 1904. That is, frame 1900 may not include feet. As such, feet may not interact with each other or different sides of frame 1900.

Figure 20:
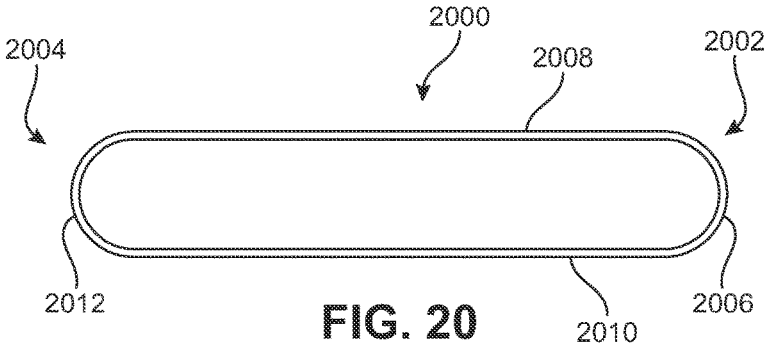
FIG. 20 is a view of another alternate embodiment of a frame.

Referring to FIG. 20, frame 2000 is depicted. In some cases frame 2000 may include a first end 2002 and a second end 2004. In some cases first end 2002 may include a head 2006. In some embodiments, head 2006 may be rounded in shape. In some cases, frame 2000 may include a first side 2008 and a second side 2010. In some cases, first side 2008 may extend toward second end 2004. In some embodiments, second side 2010 may extend toward second end 2004. In some embodiments, frame 2000 may be closed at second end 2004. As shown, frame 2000 is closed at second end 2004 and closed at first end 2002. As such, frame 2000 includes a head 2012 on the second end 2004. Head 2012 may be of the same geometry as head 2006, or may vary.

The variations of geometry, material, cross-sectional shape, and other aspects described with relation to frame 1800 are largely applicable to frame 2000. Further, the interactions between frame 1800 and the different embodiments of receptacles may be similar to the interactions of frame 2000 and the embodiments of the receptacles.

Frame 2000 may be unable to interact with receptacle 1600 in the same manner as frame 1900 and frame 1800. Because frame 2000 includes a head on either side of frame 2000, frame 2000 may not be able to slide in grooves 1603.

Figure 21:
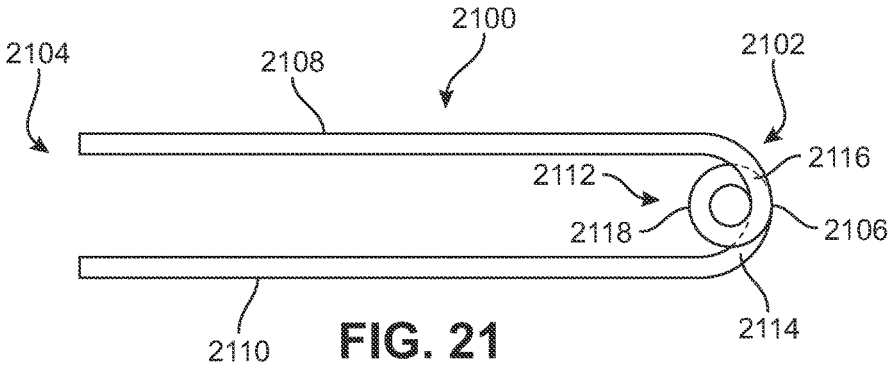
FIG. 21 is a view of another alternate embodiment of a frame.
Figure 22:
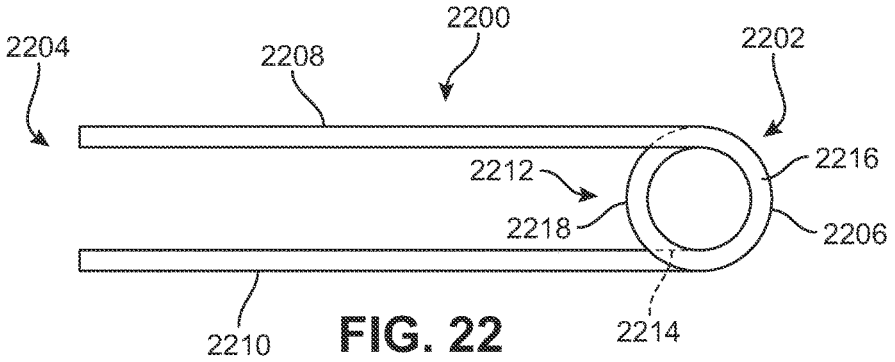
FIG. 22 is a view of another alternate embodiment of a frame.
Figure 23:
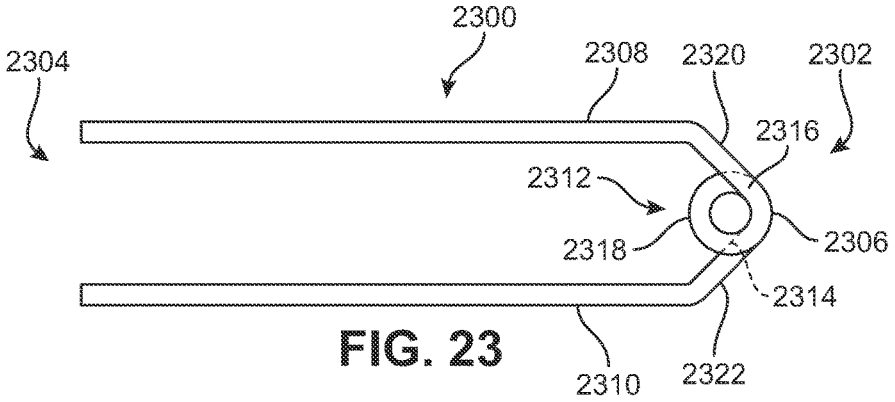
FIG. 23 is a view of another alternate embodiment of a frame.

FIGS. 21-23 illustrate various embodiments of a frame that incorporate springs that may allow for various levels of spring force in each frame. In some embodiments, the springs may be configured as torsion springs. In such embodiments, a portion of the frame is wound or coiled to form a spring portion. Referring to FIG. 21, frame 2100 is depicted. In some embodiments, frame 2100 may include a first end 2102 and a second end 2104. In some embodiments, first end 2102 may include a head portion 2106. In some embodiments, head portion 2106 may be rounded in shape. In some cases, frame 2100 may include a first side 2108 and a second side 2110. In some cases, first side 2108 may extend toward second end 2104. In some cases, second side 2110 may extend toward second end 2104.

In some embodiments, portions of frame 2100 may wrap under one another. In some embodiments, a spring portion 2112 may be formed. For example, lower portion 2114 may form a lower part of spring portion 2112. Upper portion 2116 may form an upper part of spring portion 2112. Additionally, intermediary portion 2118 may form a connection between upper portion 2116 and lower portion 2114. In this configuration, upper portion 2116, intermediary portion 2118 and lower portion 2114 combine to form spring portion 2112. In this configuration, lower portion 2114 extends below a portion of frame 2100 (shown as dotted lines) in the area of head portion 2106. Additionally, upper portion 2116 extends above portions of frame 2100 in the area of head portion 2106.

Due to the geometry of spring portion 2112, as first side 2108 and second side 2110 are brought towards one another, a spring force may push first side 2108 and second side 2110 away from one another toward the steady state shape of frame 2100. As a frame is inserted into a receptacle multiple times, the material used to form the frame may begin to bend and change shape, thereby conforming to the shape of the receptacle. That is, the ability of the frame to return to its steady state geometry may diminish. By incorporating a spring into the shape of frame 2100, frame 2100 may return to its steady state over many uses. The spring constant of spring portion 2112 may be altered by changing the geometry of spring portion 2112 or by changing the material of frame 2100.

The variations of geometry, material, cross-sectional shape, and other aspects described with relation to frame 1800 are largely applicable to frame 2100. Further, the interactions between frame 1800 and the different embodiments of receptacles may be similar to the interactions of frame 2100 and the embodiments of the receptacles.

Referring to FIG. 22, an alternate embodiment of a frame incorporating a spring portion is depicted. As shown, frame 2200 includes a first end 2202 and a second end 2204. In some embodiments, first end 2202 may include a head portion 2206. In some embodiments, head portion 2206 may be rounded in shape. In some embodiments, frame 2200 may include a first side 2208 and a second side 2210. In some cases, first side 2208 may extend toward second end 2204. In some cases, second side 2210 may extend toward second end 2204.

In some embodiments, frame 2200 may incorporate a spring portion. As shown, frame 2200 includes spring portion 2212. Spring portion 2212 may be formed from a twisting or spiral formation within frame 2200. For example, lower portion 2214 may form a lower part of spring portion 2212. Additionally, upper portion 2216 may form an upper part of spring portion 2212. Additionally, intermediary portion 2218 may form a connection between upper portion 2216 and lower portion 2214. In this configuration, upper portion 2216, intermediary portion 2218, and lower portion 2214 combine to form spring portion 2212. In this configuration, lower portion 2214 extends below a portion of frame 2200 (shown as dotted lines) in the area of head portion 2206. Additionally, upper portion 2216 extends above portions of frame 2200 in the area of head portion 2206.

Due to the geometry of spring portion 2212, as first side 2208 and second side 2210 are brought towards one another, a spring force may push first side 2208 and second side 2210 away from one another toward the steady state shape of frame 2200. The spring constant of spring portion 2212 may be altered by changing the geometry of spring portion 2212 or by changing the material of frame 2200.

In some embodiments, spring portion 2212 may be formed in various shapes and sizes. As shown in FIG. 22, spring portion 2212 extends from first side 2208 to second side 2210. That is, spring portion 2212 extends the entire distance between first side 2208 and second side 2210. Further, spring portion 2212 extends along the entire width of head portion 2206. This configuration is in contrast to spring portion 2112 of FIG. 21, in which spring portion 2112 comprises some, but not all, of the length of head portion 2106. By extending spring portion 2212 along the length of head portion 2206, frame 2200 may return to its steady state shape after use with a receptacle. After repeated uses, a frame may begin to bend and lose the shape of the frame. By incorporating spring portion 2212 across the entire length of head portion 2206, head portion 2206 may resist deformations.

In the embodiments of FIGS. 21-22, spring portion 2112 is shown to be slightly smaller relative to frame 2100 than spring portion 2212 relative to frame 2200. This difference in the coil size may result in varying levels of spring force provided by each spring to the sides of the frame.

In some embodiments, the spring constant of a spring portion may be varied. For example, spring portion 2212 may be varied in shape and size to alter the spring constant of spring portion 2212. In some embodiments, spring portion 2212 may be altered to increase the spring constant of spring portion 2212. In other embodiments, spring portion 2212 may be altered to decrease the spring constant of spring portion 2212. The spring constant may be varied for ease of use when used in conjunction with various receptacles.

The variations of geometry, material, cross-sectional shape, and other aspects described with relation to frame 1800 are largely applicable to frame 2200. Further, the interactions between frame 1800 and the different embodiments of receptacles may be similar to the interactions of frame 2200 and the embodiments of the receptacles.

Referring to FIG. 23 frame 2300 is depicted. In some embodiments, frame 2300 may include a first end 2302 and a second end 2304. In some embodiments, first end 2302 may include a head portion 2306. In some embodiments, head portion 2306 may be rounded in shape. In some cases, frame 2300 may include a first side 2308 and a second side 2310. In some cases, first side 2308 may extend toward second end 2304. In some cases, second side 2310 may extend toward second end 2304.

In some embodiments, portions of frame 2300 may wrap under one another. In some embodiments, a spring portion 2312 may be formed. Spring portion 2212 may be formed from a twisting or spiral formation within frame 2200. For example, lower portion 2314 may form a lower part of spring portion 2312. Upper portion 2316 may form an upper part of spring portion 2312. Additionally, intermediary portion 2318 may form a connection between upper portion 2316 and lower portion 2314. In this configuration, upper portion 2316, intermediary portion 2318 and lower portion 2314 combine to form spring portion 2312. In this configuration, lower portion 2314 extends below a portion of frame 2300 (shown as dotted lines) in the area of head portion 2306. Additionally, upper portion 2316 extends above portions of frame 2300 in the area of head portion 2306.

Due to the geometry of spring portion 2312, as first side 2308 and second side 2310 are brought towards one another, a spring force may push first side 2308 and second side 2310 away from one another toward the steady state shape of frame 2300. The spring constant of spring portion 2312 may be altered by changing the geometry of spring portion 2312 or by changing the material of frame 2300.

In some embodiments, a spring portion may be used in conjunction with various shapes of head portions. In some embodiments, a spring portion may be used in conjunction with a circular head portion. In other embodiments, a spring portion may be used in conjunction with a rectangular head portion. In still further embodiments, a spring portion may be used in conjunction with a triangular head portion. In still further embodiments, a spring portion may be used in conjunction with head portions of different shapes. As shown in FIG. 23, spring portion 2312 is incorporated into head portion 2306 that is largely triangular. First head portion 2320 extends from first side 2308 to spring portion 2312. Second head portion 2322 extends from second side 2310 to spring portion 2312. In some embodiments, first head portion 2320 and second head portion 2322 may extend at an angle toward spring portion 2312. In some embodiments first head portion 2320 and second head portion 2322 may extend linearly toward spring portion 2312. That is, in some embodiments, first head portion 2320 and second head portion 2322 may not be circular. This configuration is in contrast to other embodiments in which the entire head portion of a frame is generally circular in shape. By angling first head portion 2320 and second head portion 2322 a different level of spring-back may be exerted along first side 2308 and second side 2310 from other embodiments. By varying the geometry of head portion 2306, the force exerted by spring portion 2312 may be varied.

The variations of geometry, material, cross-sectional shape, and other aspects described with relation to frame 1800 are largely applicable to frame 2300. Further, the interactions between frame 1800 and the different embodiments of receptacles may be similar to the interactions of frame 2300 and the embodiments of the receptacles.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A system for retaining and transferring an article via an article frame comprising:

a frame having a first frame end, an opposing second frame end, and a head portion located at the first frame end;

a receptacle having a first receptacle end and a second receptacle end, wherein the receptacle is configured to accept the frame such that the frame is in a fixed orientation with respect to the receptacle and such that the head portion of the frame extends beyond the first receptacle end of the receptacle;

the receptacle configured to removably accept the article while the frame is in the fixed orientation with respect to the receptacle and releasably coupled thereto;

wherein the frame has an outwardly biased configuration such that it is configured to exert a radial force along an inner surface of the article; and wherein the head portion is a spring and defines a grasping portion; and wherein the grasping portion can be used to remove the frame and the article from the receptacle while retaining the article in a fixed relation to the frame.

2. The system of claim 1, wherein the receptacle includes an alignment portion.

3. The system of claim 2, wherein the alignment portion comprises at least one groove.

4. The system of claim 2, wherein the alignment portion accepts a sliding engagement with the frame.

5. The system of claim 4, wherein the receptacle comprises a lumen, and the alignment portion is situated on an interior surface of the lumen.

6. The system of claim 4, wherein the alignment portion is situated on an exterior surface of the receptacle.

7. The system of claim 1, wherein the article is a sock.

8. The system of claim 1, wherein the receptacle has a substantially cylindrical shape.

9. The system of claim 1, wherein the receptacle has a rectangular cross-sectional shape.

10. The system of claim 1, wherein the receptacle has a triangular cross-sectional shape.

11. The system of claim 1, wherein the frame comprises an elastic material.

12. The system of claim 1, wherein the head portion of the frame has a semi-circular shape.

13. The system of claim 1, wherein the head portion of the frame comprises a spring.

14. The system of claim 1, wherein the receptacle further comprises a stop, and wherein the stop is configured to engage the frame in such a way as to limit the movement of the frame with respect to the receptacle.

15. The system of claim 14, wherein the second end of the frame comprises a foot portion, and wherein the foot portion is configured to engage the stop.

16. The system of claim 1, wherein the receptacle is configured to accept insertion of the frame.

17. A system for retaining and transferring an article via an article frame comprising:

a frame having a first frame end, an opposing second frame end, and a head portion located at the first frame end;

a receptacle having a first receptacle end and a second receptacle end, wherein the receptacle is configured to accept the frame such that the frame is in a fixed orientation with respect to the receptacle and such that the head portion of the frame extends beyond the first receptacle end of the receptacle;

the article configured to be disposed over the receptacle and the frame while the frame is in the fixed orientation with respect to the article and releasably coupled thereto such that the article at least partially covers the receptacle and the frame;

wherein the frame has an outwardly biased configuration to exert a radial force along an inner surface of the article; and wherein the head portion defines a grasping portion; and wherein the grasping portion can be used to remove the frame and the article from the receptacle while retaining the article in a fixed relation to the frame.

* * * * *